United States Patent [19]

Ashley et al.

[11] 4,455,776

[45] Jun. 26, 1984

[54] SIGHT MOUNT DEVICE

[76] Inventors: R. B. Ashley, 8801 Cottingham Way, Louisville, Ky. 40258; Glenn E. Kamer, R.R. #2, DePauw, Ind. 47115

[21] Appl. No.: 304,620

[22] Filed: Sep. 22, 1981

[51] Int. Cl.[3] ..... F41G 1/38

[52] U.S. Cl. ..... 42/1 ST

[58] Field of Search ..... 42/1 ST; 33/245–250

[56] References Cited

U.S. PATENT DOCUMENTS

| | | | |
|---|---|---|---|
| 2,645,855 | 7/1953 | Ivy | 33/248 |
| 3,555,687 | 1/1971 | Joseph | 33/245 |
| 3,834,052 | 9/1974 | Steck | 42/1 ST |
| 3,922,794 | 12/1975 | Ackerman, Jr. | 42/1 ST |
| 4,044,486 | 8/1977 | Van Holten | 42/1 ST |

FOREIGN PATENT DOCUMENTS

| | | | |
|---|---|---|---|
| 1253435 | 11/1971 | United Kingdom | 33/248 |

*Primary Examiner*—Charles T. Jordan

*Attorney, Agent, or Firm*—Edward M. Steutermann

[57] ABSTRACT

A sight mount for a firearm having a receiver and stock to carry a barrel where the mount includes a U shaped body having first and second leg means extending outwardly therefrom in generally spaced parallel relation so that one leg is received on either side of the receiver and where the legs have at least one aligned aperture adjacent the lower edge thereof for attachment to the receiver and where the first leg of the mount has a first notch to expose the ejection port of the receiver and a second notch to receive a pin carried by a bolt provided in the receiver.

1 Claim, 1 Drawing Figure

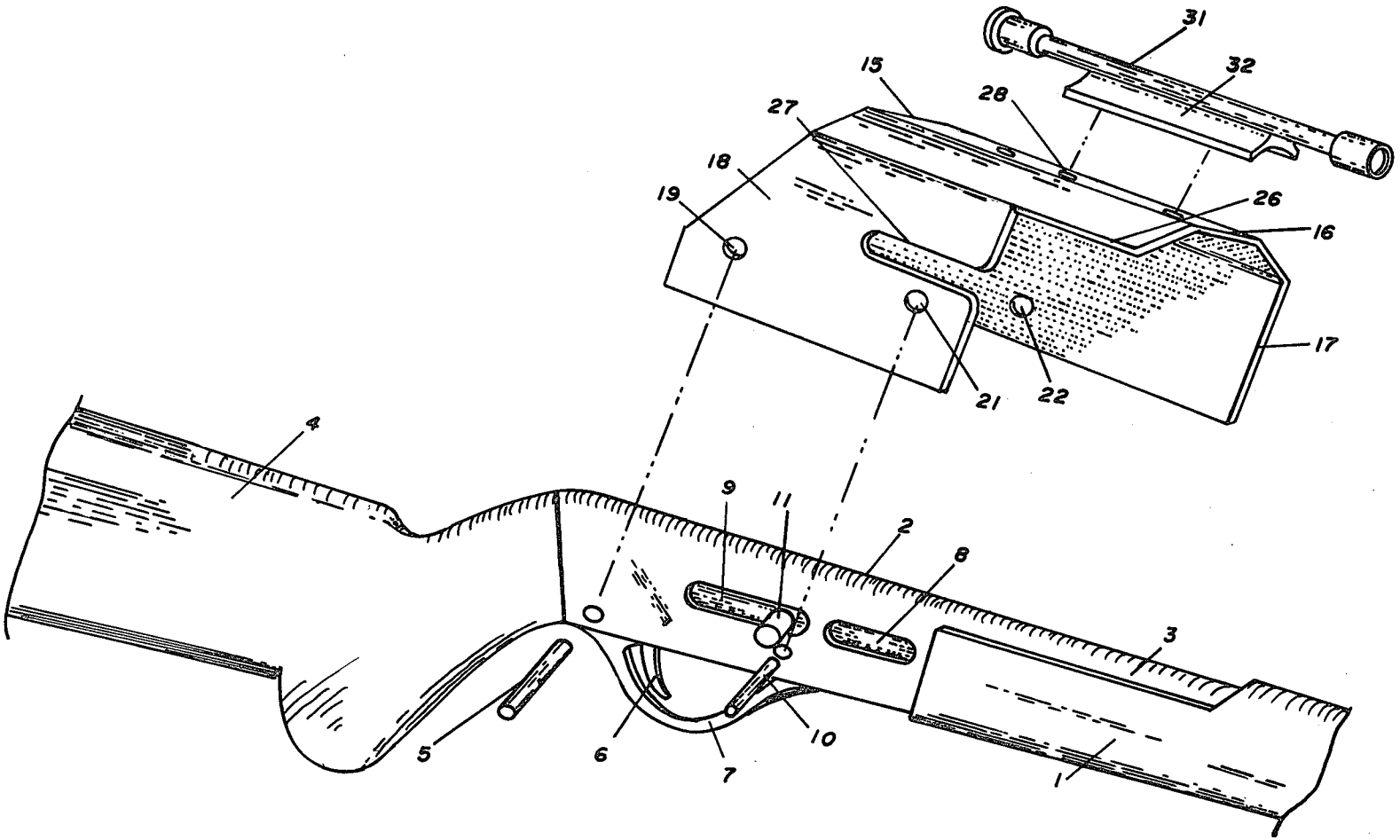
31
32
28
15
27
18
19
26
16
17
22
21
4
5
6
7
10
9
11
2
8
3
1

SIGHT MOUNT DEVICE

BACKGROUND OF THE INVENTION

The present invention relates to mounts for sights for a firearm, for example telescopic sights for guns having a barrel to be carried by a receiver including an ejection port, bolt, and operating handle carried by the bolt.

The prior art has provided mounts for guns of various types including shotguns and rifles but generally such mounts, when utilized in connection with a telescopic sight as shown in U.S. Pat. No. 2,119,925, or other sight attached to the gun have included a single leg which is attached to the receiver by means of a bolt or other means as shown in U.S. Pat. No. 3,979,848. In some cases the mount is attached by the fastener means provided by the manufacturer. Other arrangements taught by the prior art are shown in U.S. Pat. Nos. 3,012, 350; 3,365,801; 1,710,547; British Pat. No. 1,253,435 and German Pat. No. 348,744.

In use, such prior art devices have not been approved stable. Specifically, such mounts have usually provided only a single point attachment to the associated gun and the mount and sight have been misaligned in carrying the gun through underbrush or other close quarters.

Further, such prior art sight mounts have been susceptable to bending because even where securely attached to the receiver or other portion of the gun the leg utilized is bent if the gun is dropped or mishandled.

No prior art device is known to provide a sight mount which is attached on opposite sides of the receiver by means of a "U" mount to provide suitable stability to the sight and the mounting arrangement and to prevent misalignment of the sight when the gun is struck or otherwise mishandled.

SUMMARY OF THE INVENTION

The present invention provides a new and improved mounting arrangement for a sight for a gun having a stock, barrel and receiver assembly including a bolt, with operating handle or pin carried thereby and a shell ejection port where the mount is carried by fixtures on opposite sides of the receiver and accomodates the ejection port of the receiver as well as movement of the bolt and operating handle or pin.

Mounting arrangements within the scope of the present invention are economical to fabricate and extremely stable when attached to the receiver of a gun such as a rifle or a shotgun.

More particularly, the present invention provides a sight mount for a firearm having a receiver and stock to carry a barrel where the mount includes a U shaped body having first and second leg means extending outwardly therefrom in generally spaced parallel relation so that one leg is received on either side of the receiver and where the legs have at least one aligned aperture adjacent the lower edge thereof for attachment to the receiver and where the first leg of the mount has a first notch to expose the ejection port of the receiver and a second notch to receive a pin carried by a bolt provided in the receiver.

Various other arrangements also within the scope of the present invention will occur to those skilled in the art upon reading the disclosure set forth hereinafter.

BRIEF DESCRIPTION OF THE DRAWINGS

The single drawing herein illustrates in exploded view, a gun including a receiver, a slightly enlarged perspective view of a sight mount within the scope of the present invention and a sight.

DETAILED DESCRIPTION OF THE DRAWINGS

The associated FIGURE illustrates, in exploded perspective view, a rifle 1 having a receiver 2 for the gun, for example a shotgun or a rifle with a barrel 3 and a stock 4. Receiver 2 includes a trigger 6, trigger guard 7, a shell ejection port 8 where a bolt 9 is provided within the ejection port and an operating handle 11 is carried by the bolt.

The sight mount within the scope of the present invention, as illustrated, includes a U shaped body 16 having a first leg 17 and a second leg 18 extending downwardly therefrom in spaced parallel relation. Leg 18 includes apertures 19 and 21 where aperture 21 is in aligned relation with aperture 22 of leg 17 and it will be understood that a second aperture (not shown) is in aligned relation with aperture 19.

Mount 15 is secured to receiver 2 by means of pins or bolts 5 and 10 commonly provided in the receiver of both rifles and shotguns. Pins 5 and 10 are removed, (and replaced with longer ones), mount 15 is then placed in position straddling receiver 2 and the pins extend through apertures 19, 21, 22 to secure the mount to the receiver.

It will be noted that leg 18 includes a first notch 26 shaped to expose the ejection port 27 to permit ejection of shells from receiver 2 and a second notch 27 adapted to receive the operating handle 11 during operation of the receiver.

Apertures 28 can be provided in the uppermost portion of U 16 to provide mounting for a sight 31 as is known in the art which includes a base 32 commonly provided to secure a scope to a gun or in the present case to the mount.

Devices within the scope of the present invention can be fabricated from steel, for example 14 guage steel and can be covered with a protective coating such a teflon to avoid scratching the receiver or other portions of the gun. Further, as shown in the FIGURE, the front portion of the mount can be chamfered to further reduce the weight of the mount without affecting the mounting effectiveness.

It is to be understood that the foregoing is but one example of a sight mount within the scope of the present invention and that various other embodiments also within the scope of the present invention will occur to those skilled in the art upon reading the disclosure set forth hereinafter.

The invention claimed is:

1. A sight mount for a firearm having a receiver having an ejection port for expulsion of spent shells therefrom and a stock to carry a barrel where the mount includes a U shaped body having first and second leg means extending outwardly therefrom in generally spaced parrallel relation so that one leg is received on either side of the receiver and where the legs have at least one aligned aperture adjacent the lower edge thereof for attachment to the receiver and where the first leg of the mount has notch means to expose said ejection port of the receiver and a second notch to receive a pin carried by a bolt provided in the receiver.

* * * * *